US006776415B2

(12) United States Patent
Robinson et al.

(10) Patent No.: US 6,776,415 B2
(45) Date of Patent: Aug. 17, 2004

(54) METHOD OF AND APPARATUS FOR PLAYING A CASINO CARD GAME

(75) Inventors: Daniel A. Robinson, Gig Harbor, WA (US); Joseph C. Baseel, 307 NE. 23rd Pl., Long Beach, WA (US) 98631

(73) Assignee: Joseph C. Baseel, Long Beach, WA (US)

( * ) Notice: Subject to any disclaimer, the term of this patent is extended or adjusted under 35 U.S.C. 154(b) by 0 days.

(21) Appl. No.: 10/177,113

(22) Filed: Jun. 21, 2002

(65) Prior Publication Data

US 2003/0234491 A1 Dec. 25, 2003

(51) Int. Cl.[7] ..... A63F 1/00

(52) U.S. Cl. ..... 273/292; 273/138.1; 273/274; 463/12

(58) Field of Search ..... 273/292, 138.1, 273/274, 303; 463/12–13

(56) References Cited

U.S. PATENT DOCUMENTS 5,632,489 A * 5/1997 Rozzi et al. ..... 273/304
5,746,432 A * 5/1998 Feola ..... 273/274
5,863,042 A * 1/1999 Lo ..... 273/292
6,179,293 B1 * 1/2001 Hedman ..... 273/292
6,508,470 B1 * 1/2003 Yuan ..... 273/292
2003/0151200 A1 * 8/2003 Lee ..... 273/292

OTHER PUBLICATIONS

"The way to play" by Diagram group pp. 216–223.*
Harrh'a how to play 9's up game, pp. 1–2.*

* cited by examiner

*Primary Examiner*—Vishu K Mendiratta
(74) *Attorney, Agent, or Firm*—James F. Leggett

(57) ABSTRACT

Method and apparatus for playing a casino card game with the object to get the numerical value of 9, being comprised of each player placing one wager and an optional Jackpot Side bet; the dealer dealing each player four face up cards and the dealer four face down cards; each player's four cards compared with the Jackpot Side bet combinations; each player selecting a two card front hand and a two card back hand and then the dealer turning over the dealer's four cards and selecting a two card front hand and back hand, and each player's front hand and back hand measured against the dealer's front hand and back hand. In the event of a tie, the dealer deals a tie breaker card for the player and a tie breaker card for the dealer with the highest card winning, dealer winning ties.

7 Claims, 3 Drawing Sheets

METHOD OF AND APPARATUS FOR PLAYING A CASINO CARD GAME

FIELD OF THE INVENTION

This invention relates generally to an apparatus and method of playing a card game and more particularly a card game that may be played in a casino and played player versus the dealer, the house, wherein the object is to have a total card count as close to a predetermined number as possible.

BACKGROUND OF THE INVENTION

Card games, using poker cards in which the object is to have the face value of the cards add up to a target number are well known and include 21, Baccarat, 5 and a half twenty-one and a half, three thirty-three, and others too numerous to list. The value of face cards have been set as zero, one-half, or their actual value in the poker suit sequence depending upon the rules of the game. Some of these card games have been transferred to the Casino environment, such as L. Bartlett U.S. Pat. No. 5,529,309 disclosing single hand Baccarat with the dealer as the bank and allowing side bets, R. Coleman U.S. Pat. No. 5,857,678 where a player performs the bank function of single hand Baccarat with a dealer, F. Terminal U.S. Pat. No. 6,095,525 where 21 is played with 2 side bets and O. Ventura, U.S. Pat. No. 6,179,291B1 variation of 21 wherein pay outs are based upon the numerical value of each card dealt to a player versus the previous card dealt to the same player and the total number of successful cards received without exceeding the target number, 21, and M. Timpano, U.S. Pat. No. 6,237,917B1 which added a double payout for a pair of 9s to a Baccarat game.

While games such as those described above are interesting, there are a number of drawbacks. These types of card games are not readily transferrable to a commercial casino. The commercial casino must show a profit and the way that it does this is to provide games which are fast, relatively fair to the player, require little or no calculation by the player or dealer, provide the opportunity for the player to win a large jackpot, and provide the house with a comfortable profit margin, both by favorable odds and by quick games so that the house's commission on winning bets is maximized for a given time period.

Therefore, the primary object of this invention is to provide commercial casinos a table card game which takes little time to complete, so that the commission take on each winning bet add up quickly, while the players experience a fast and non-complex game which provides the opportunity for the player to win a large jackpot while providing the house with a comfortable profit margin. A further object of this invention is to provide a card game with non-complex rules so that dealers are not required to be over qualified and the potential for disputes the players and the dealers is minimized. This is especially important where alcohol is served to players.

SUMMARY OF THE INVENTION

The foregoing objectives are satisfied by this invention, which is comprised of the method and apparatus for playing a casino card game with the object to get the numerical value of 9, being comprised of each player placing one wager and an optional Jackpot Side bet; the dealer dealing each player four face up cards and the dealer four face down cards; each player's four cards compared with the Jackpot Side bet combinations; each player selecting a two card front hand and a two card back hand and then the dealer turning over the dealer's four cards and selecting a two card front hand and back hand, and each player's front hand and back hand measured against the dealer's front hand and back hand. In the event of a tie, the dealer deals a tic breaker card for the player and a tie breaker card for the dealer with the highest card winning, dealer winning ties.

The novel features of the invention will be best understood from the following description in light of the accompanying drawings. While particular embodiments of the present invention are shown and described, it will be obvious to those skilled in the art that changes and modifications may be made without departing from this invention in its broader aspects and, therefore, the aim of the appended claims is to cover all such changes and modifications as fall within the true spirit and scope of this invention.

DESCRIPTION OF THE PREFERRED EMBODIMENTS

Figure 1:
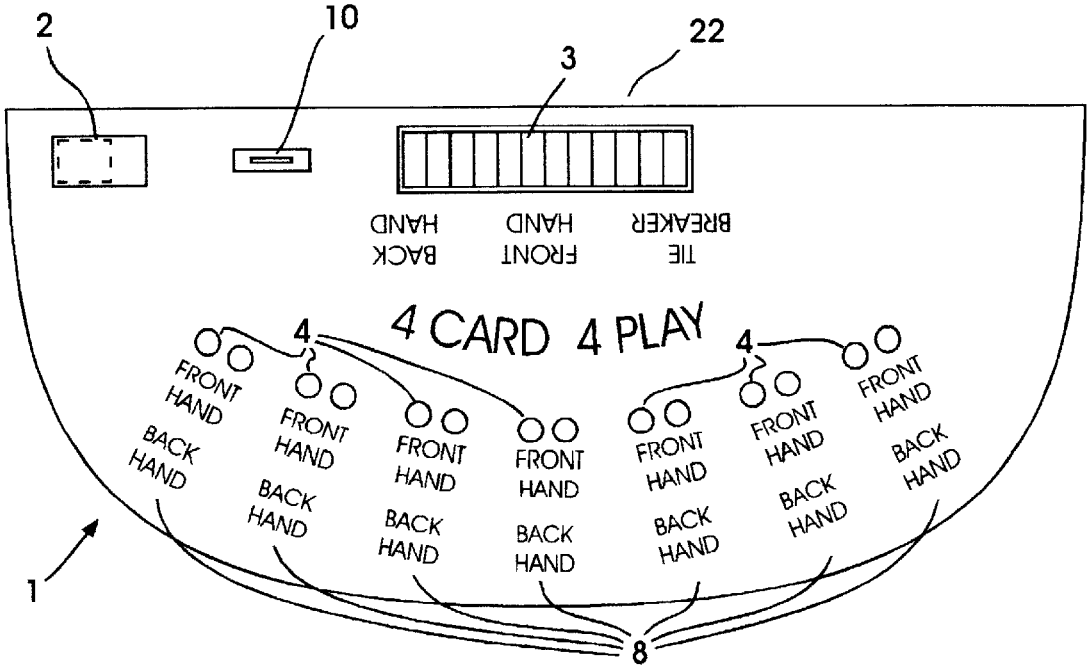
FIG. 1 is an overhead view of the apparatus for playing the method of the invention.
Figure 2:
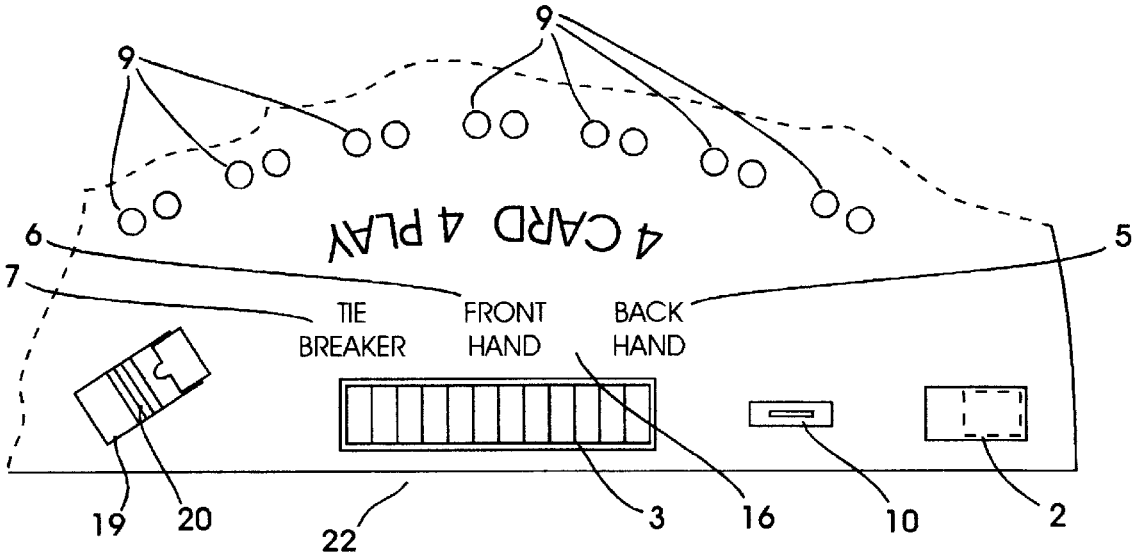
FIG. 2 is an expanded overhead view of the dealer's area of the apparatus.

With reference to the drawings and particularly FIG. 1 and FIG. 2 thereof, the preferred embodiment of the Apparatus for Playing a Casino Card Game is shown. The preferred apparatus is a layout (1), compatible in size and shape with casino Black Jack/21 gaming tables, having a used card storage tray (2) and chip tray (3), poker cards (20) numbering 6 standard decks, shuffled and placed into a card shoe (19) and betting tokens (21). The layout(1) has a dealer's area (22), comprised of the chip tray (3), used card storage tray (2), dealer's back hand card area (5), dealer's front hand card area (6), a money slot (10), Tie Breaker card area (7) and dealer's dealt card area (16), and a number of player's areas (8), comprised of a player's bet area (9), player's Jackpot Side bet area (4), player's dealt card area (11), player's back hand card area (12), and player's front hand card area (13).

Figure 3:
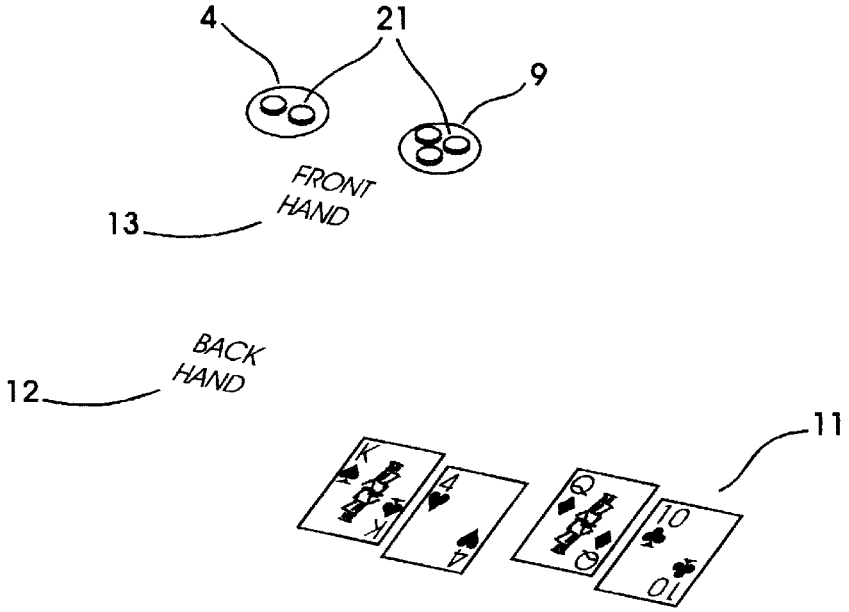
FIG. 3 is an expanded overhead view of one player's area of the apparatus with that player's hand dealt but not allocated.
Figure 4:
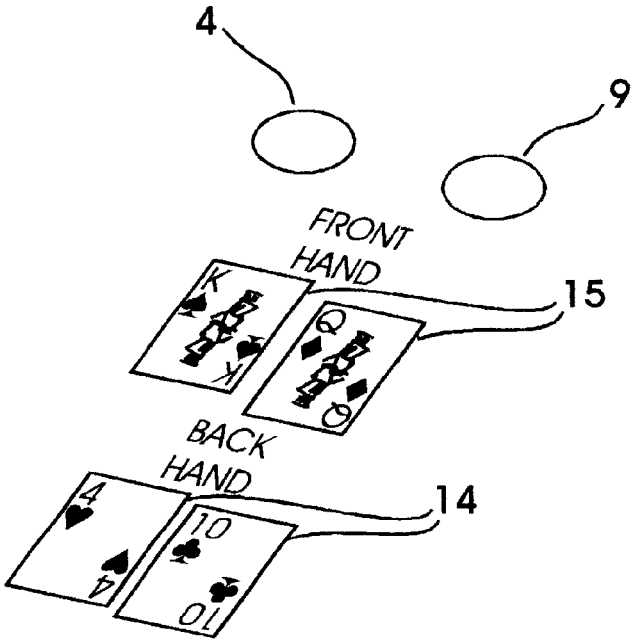
FIG. 4 is an expanded overhead view of one player's area of the apparatus with the player's hand allocated.
Figure 5:
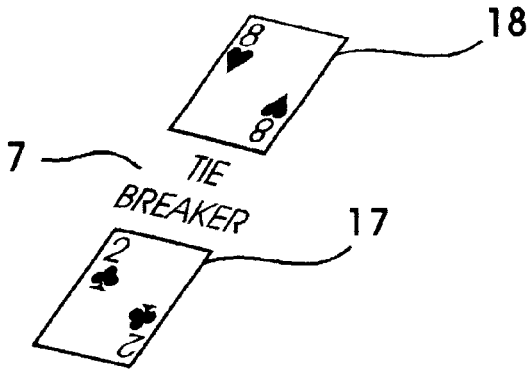
FIG. 5 is an expanded, overhead view of the Tie Breaker card area.

With reference to the drawings and particularly FIGS. 3, 4 and 5 thereof, the preferred embodiment of the Method for Playing a Casino Card Game is shown. Each player competes against the dealer only and the object is to get two card hand or hands having the face value of poker cards (20) to add up to 9 and to beat the dealer's two card hands, the face cards (15) of the poker cards (20) counting zero and the non-face cards (14) of the poker cards (20) counting their face values. The preferred embodiment of the method of the invention, with reference to FIG. 3, is comprised of each player, prior to the deal, making one wager, by placing one or more betting tokens (21) in the player's bet area (9), and each player may, but is not required to, make a second wager by placing betting tokens (21) into the Jackpot Side bet area (4). Each player receives four poker cards (20) face up in the player's dealt card area (11) and the dealer receives four poker cards face down. The four poker cards (20) face up in the player's dealt card area (11), of each player who placed betting tokens (21) in the Jackpot Side bet area (4), are measured against the Winning Combinations and Payoff Odds of Table I and winners are paid by the dealer.

TABLE I

| Hand Type | Pays |
|---|---|
| 4 of a kind suited | 2000 to 1 |
| Total of 40 suited | 750 to 1 |
| 4 of a kind unsuited | 299 to 1 |
| 9–9 vs. 9–9 | 200 to 1 |
| 3 of a kind suited | 150 to 1 |
| 3 of a kind unsuited | 10 to 1 |
| Any two pair | 8 to 1 |

Only the highest winning combination is paid. If both player hands are 9 and both dealer hands are 9, the player is paid at odds of 200 to 1. The "total of 40 suited" can be composed of different 10 value cards such a Jack, King, Queen or ten.

The method of the preferred embodiment, with reference to FIG. 4, comprises the player sorting the four cards in the player's dealt card area (11) and splitting them into two separate hands of two cards each and placing one hand in the player's front hand card area (13) and one hand in the player's back hand card area (12), provided that the value of the hand in the player's back hand area (12) must not be lower than the value of the hand in the player's front hand area (13).

With reference to FIG. 2, once the players have sorted and placed their two hands in the appropriate areas, then the dealer turns over the four cards in the dealer's dealt card area (16) and sorts the four cards according to the predetermined house strategy, discussed below, such as sorting the two poker cards placed into the dealer's back hand area (5) as high as possible, except when that sorting would determine the two cards in the dealer's front hand card area (6) would total zero and the cards in the dealer's back hand card area (5) would total less than 9. In the latter situation, the dealer must sort both hands so as to total as close to each other as possible although the two cards in the dealer's back hand card area (5) must still be equal in total value to or greater than the two cards in the dealer's front hand card area (6). The dealer then compares the total value of the cards in each player's front hand card area (13) with the total value of the cards in the dealer's front hand card area (6) and the total value of the cards in each player's back hand card area (12) with the total value of the cards in the dealer's back hand card area (5) and pays an amount of betting tokens (21) equal to those placed into the player's bet area (9) or takes the betting tokens (21) therefrom based upon the following predetermined house formula:

Winning both hands is a win and losing both hands is a loss;

A tie of one hand and a win of one hand is a player win;

A tie of one hand and a loss of one hand is a loss;

An actual tie is a tie of both hands or a win of one hand and a loss of one hand.

In the event of a tie, referring to FIG. 5, the dealer will deal two more cards in the tie breaker card area (7) face up, the first card being the player's tie breaker card (17) and the second card being the dealer's tie breaker card (18). If the player's tie breaker card (17) is higher, cards now being counted as ranked in a poker deck, than the dealer's tie breaker card (18) the player wins. If the dealer's tie breaker card (18) is higher than or the same as the player's tie breaker card (17) then the dealer wins. Suits are irrelevant. All winning bets are charged a 5% commission by the dealer/house.

The odds between the house and the player, excluding the Jackpot Side bet, of the method of the preferred embodiment described above, assuming the player applies the optimal strategy, show the player will win 49.5933% of the time, lose 48.5294% of the time and tie 1.8774% of the time:

$$49.5933\% \times 0.95 - 48.5294\% - 1.8774\% = 47.1136\% - 48.5294\% - 1.877\% = \% - 3.3931.$$

The foregoing odds are based upon 1820 4 card hands. Of the 1829 hands 942 can be set on the way, 696 can be set two ways and 182 can be set three ways. If no "tiebreaker" cards were drawn in the event of a tie, then there would only be need to look at 715 distinct 4 card palyer hands. Of the 715 hands 335 can be set one way, 300 can be set two ways and 80 can be set three ways.

Although the present invention has been described in terms of the preferred embodiment, it will be appreciated by those reasonably skilled in the art that numerous novel aspects of the present invention, including applying it to differenht target numbers, i.e. 21, 5 and a half, etc. or changing the house strategy and the dealer options, based upon the ability of the dealers to commit the optimal house strategy to memory, or the number of card in any one hand and the number of hands, will be apparent and fall within the obvious variations of the invention and present disclosure.

We claim:

1. A method for playing a casino card game in which at least one player competes against a dealer using at least one deck of poker cards, an object being to get a two card hand or hands having the total face value of poker cards to add up to a predetermined target number where face cards are set at a value different than their face or numerical value, comprising each player making one wager by placing one or more betting tokens in a player's bet area;

each player making an optional second wager by placing one or more betting tokens into a Jackpot Side bet area;

each player receiving four poker cards face up in a player's dealt card area;

the dealer receiving four poker cards face down in a dealer's dealt card area;

each player's four poker cards being face up, where said player has made a second wager placing one or more betting tokens into the Jackpot Side bet area, are measured against a predetermined Winning Combinations and Payoff odds Table and the player is paid accordingly;

each player sorting the four cards in the player's dealt card area and splitting then into two separate hands of two cards each and placing one hand in the player's front hand card area and one hand in the player's back hand card area, provided that the total face value of the hand in the player's back hand card area must not be lower than the total face value of the hand in the player's front hand card area;

the dealer turning over the four cards in the dealer's dealt card area and sorting the four cards into two two card hands, according to a predetermined house strategy, and placing one two card hand in the dealer's front hand card area and one two card hand into the dealer's back hand area, provided that the total face value of the hand in the dealer's back hand card area must not be lower than the total face value of the hand in the dealer's front hand card area;

comparing the total face value of the cards in each player's front hand card area to the total face value of the cards in the dealer's front hand card area and comparing the total face value of the cards in each player's back hand card area with the total face value of the cards in the dealer's back hand card area and the dealer paying an amount of betting tokens equal to those placed into the player's bet area or taking tokens therefrom based upon a predetermined house formula which includes a means to determine and resolve ties;

resolving a tie between a player and the dealer by dealing two poker cards face up in a Tie Breaker card area, the first card being the player's tie breaker card and the second card being the dealer's tie breaker card, having the value of each counted as the poker card ranks in a poker deck with the highest ranked card winning, suits being irrelevant and the dealer winning ties;

the dealer charging a predetermined commission on all winning bets;

the predetermined house strategy for sorting the dealers four cards into two card hands comprising sorting the two poker cards placed into the dealer's back hand card area to have a high as possible total face value, except when that sorting would determine the two poker cards in the dealer's front hand card area would have a total face value of zero and the face value of the poker cards in the dealer's back hand card area would total less than 9, in which case the dealer must sort both two card hands so as to have a total face value as close to each other as possible. while the total face value of the two poker cards in the dealer's back hand card area must still be equal to or greater than the total face value of the two poker cards in the dealer's front hand card area.

2. The method for playing a casino card game of claim 1 wherein the target total face value number for a two card hand is nine, with face cards of the poker cards counting zero and non-face cards of the poker cards counting their face values.

3. The method for playing a casino card game of claim 1 wherein the predetermined Winning Combination and Pay-off odds Table is:

| Hand Type | Pays |
|---|---|
| 4 of a kind suited | 2000 to 1 |
| Total of 40 suited | 750 to 1 |
| 4 of a kind unsuited | 299 to 1 |
| 9–9 vs. 9–9 | 200 to 1 |
| 3 of a kind suited | 150 to 1 |
| 3 of a kind unsuited | 10 to 1 |
| Any two pair | 8 to 1 |

wherein only the highest combination is paid and, if both player hands are 9 and both dealer hands are 9, the player is paid odds of 200 to 1 and the total of 40 suited can be composed of different 10 value cards as Jack, King, Queen or ten.

4. The method of playing a casino card game of claim 1 wherein a predetermined house formula, for paying on the comparison of the total face value of the two poker cards in each player's front hand card area to the total face value of the two poker cards in the dealer's front hand card area and comparing the total face value of the two poker cards in each player's back hand card area with the total face value of the two poker cards in the dealer's back hand area, comprises:

a player winning both hands in a win and losing both hands in a loss;

a tie of one hand and a win of one hand is a player win;

a tie of one hand and a loss of one hand is a player loss; and an actual tie is a tie of both hands or win of one hand and a loss of one hand.

5. The method for playing a casino card game of claim 1 wherein a predetermined commission to be charged by the dealer on all winning bets being five percent.

6. The method for playing a casino card game of claim 1, wherein said method is implemented on a gaming table, comprising:

a table top having a layout;

said layout including a dealer's dealt card area, a dealer's back hand card area, a dealer's front hand card area and a tie breaker card area; and said layout including a number of player's dealt card area, a player's bet area, a player's jackpot side bet area, a player's back hand card area and a player's front hand card area.

7. The apparatus for playing a casino card game of claim 6 wherein there are seven player areas.

* * * * *